US005573416A

United States Patent [19]

Morlion et al.

[11] Patent Number: 5,573,416

[45] Date of Patent: Nov. 12, 1996

[54] CONNECTOR FOR SHIELDED CABLES

[75] Inventors: Danny Morlion, St. Amandsberg; Luc Jonckheere, Dilbeek; Jan P. K. Van Koetsem, Zwijndrecht; Eddy K. Creelle, Dendermonde, all of Belgium

[73] Assignee: Framatome Connectors International, Paris, France

[21] Appl. No.: 340,212

[22] Filed: Nov. 16, 1994

[30] Foreign Application Priority Data

Nov. 19, 1993 [NL] Netherlands ..... 9302005

[51] Int. Cl.[6] ..... H01R 13/28

[52] U.S. Cl. ..... 439/291; 439/447; 439/464

[58] Field of Search ..... 439/289–291, 439/445–447, 498, 464

[56] References Cited

U.S. PATENT DOCUMENTS

| | | | |
|---|---|---|---|
| 4,220,387 | 9/1980 | Biche et al. | 439/445 |
| 4,605,276 | 8/1986 | Hasircoglu . | |
| 4,744,769 | 5/1988 | Grabbe et al. | 439/284 |
| 4,804,342 | 2/1989 | Rudy, Jr. et al. | 439/467 |
| 4,884,981 | 12/1989 | Chandler et al. | 439/284 |
| 4,900,265 | 2/1990 | Gridley et al. | 439/449 |
| 5,334,044 | 8/1994 | Falossi et al. | 439/447 |

FOREIGN PATENT DOCUMENTS

| | | | |
|---|---|---|---|
| 2618952 | 2/1989 | France | 439/291 |
| 25 25 624 | 12/1976 | Germany . | |

OTHER PUBLICATIONS

IBM Technical Disclosure Bulletin, Feb. 1968, US, vol. 10, No. 9, p. 1353 "Cable Connector".

*Primary Examiner*—P. Austin Bradley
*Assistant Examiner*—Jill Demello
*Attorney, Agent, or Firm*—Perman & Green

[57] ABSTRACT

A connector for shielded cables comprises a housing and signal and ground contacts mounted in the housing, the housing having an upper wall with inlet openings for the cables. A strain relief member for each cable joins an inlet opening, each strain relief member being unitary with the upper wall of the housing and projecting from the upper wall, wherein the shape of each strain relief member is adapted to the outer jacket of the corresponding cable.

17 Claims, 15 Drawing Sheets

CONNECTOR FOR SHIELDED CABLES

BACKGROUND OF THE INVENTION

The invention relates to a connector for shielded cables, comprising a housing and signal and ground contacts mounted in said housing, said housing having an upper wall with inlet openings for the cables.

In the known connectors of this type problems occur with respect to providing a strain relief for the cables connected to the connector. In a shielded cable, like a coaxial or twinaxial cable, the impedance of the cable is also determined by the dielectric lying the signal conductor and the shielding. In shielded cables of high quality this dielectric consists of a relatively soft plastic material so that deformation of this plastic material easily occurs if high strain or compressing forces are exerted on the cable. This deformation results into a change of the impedance which adversely affects the transmission characteristics of the cable for high frequency signals.

It is an object of the invention to provide a connector of the above-mentioned type, wherein a strain relief is provided in a simple manner such that deformation of the dielectric plastic material of the cable can be controlled.

SUMMARY OF THE INVENTION

To this end the connector according to the invention is characterized by a s train relief member for each cable joining an inlet opening, each strain relief member being unitary with the upper wall of the housing and projecting from said upper wall, wherein the shape of each strain relief member is adapted to the outer jacket of the corresponding cable.

Thereby, a connector is obtained which is provided with a strain relief member being unitary with the housing of the connector and while joining the inlet opening for the cable extends along a part of this cable, so that the forces exerted on the cable are distributed along a large surface of the outer jacket of the cable, whereby deformation of the dielectric plastic material can be controlled.

According to a simple embodiment each strain relief member comprises a support projecting from the upper wall having a support face adapted to the Shape of the outer jacket of the cable, and a pressing member for pressing the corresponding cable against the support face, wherein preferably one or more supports join an inlet opening at both sides and comprise at both sides a support face adapted to the shape of the outer jacket of the cable.

BRIEF DESCRIPTION OF THE DRAWINGS

The invention will be further explained hereinafter by reference to the drawings, in which some embodiments of the connector according to the invention are shown.

DETAILED DESCRIPTION OF THE PREFERRED EMBODIMENTS

Figure 1:
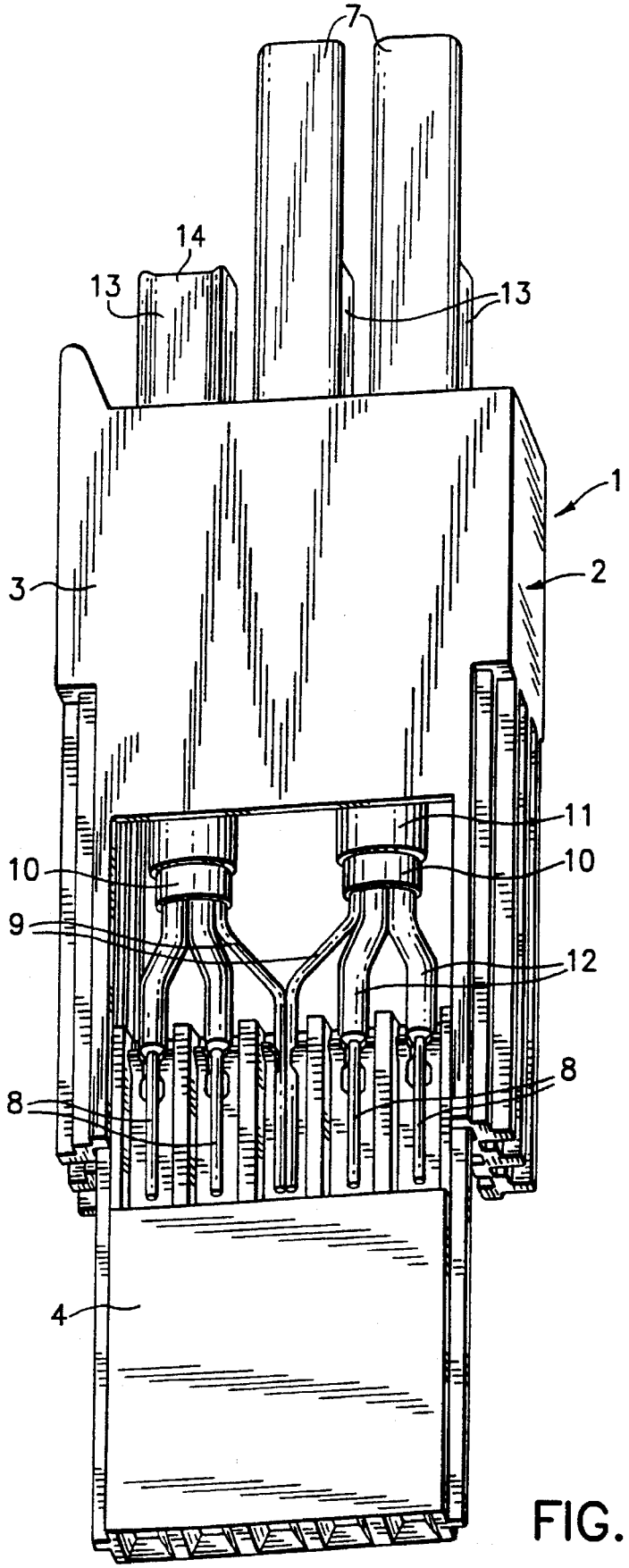
FIG. 1 schematically shows a perspective view of a first embodiment of the connector according to the invention in a partially disassembled position.
Figure 2:
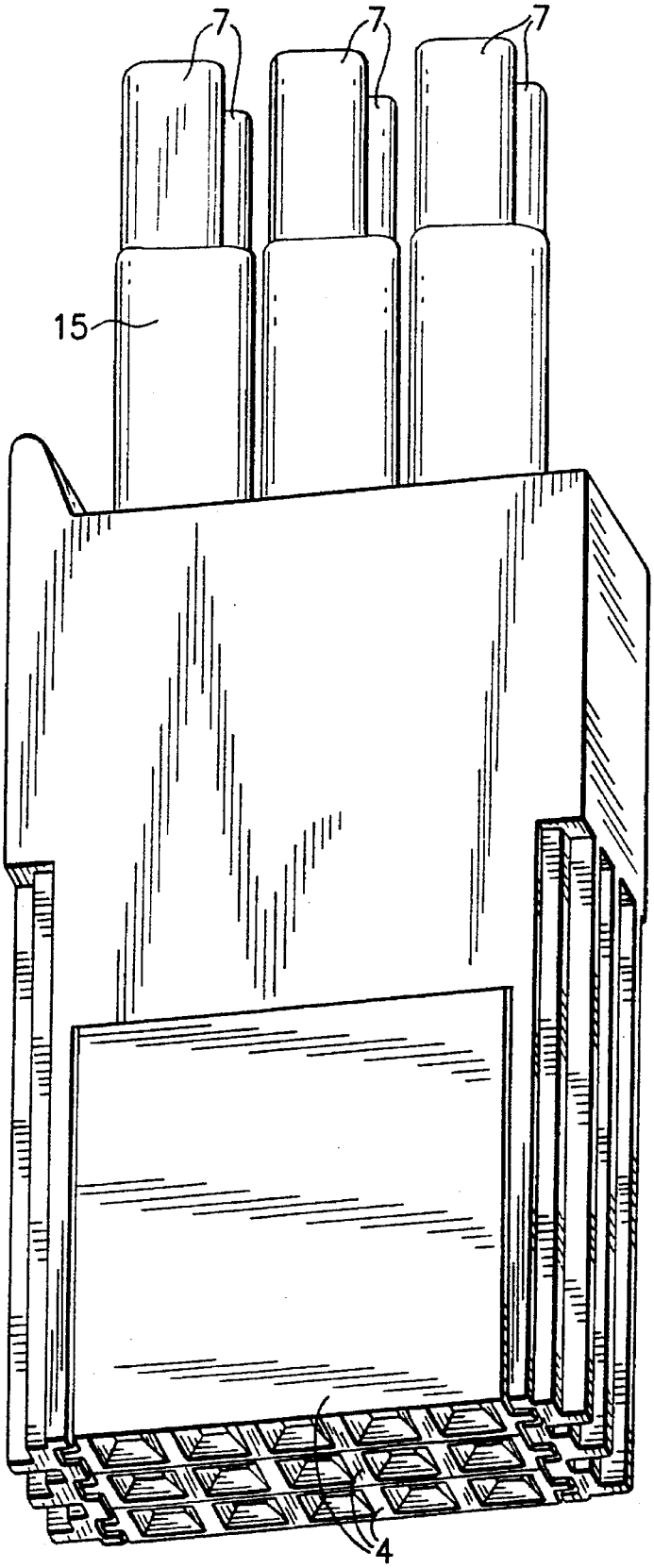
FIG. 2 is a perspective view of the connector of FIG. 1 in its assembled position.
Figure 3:
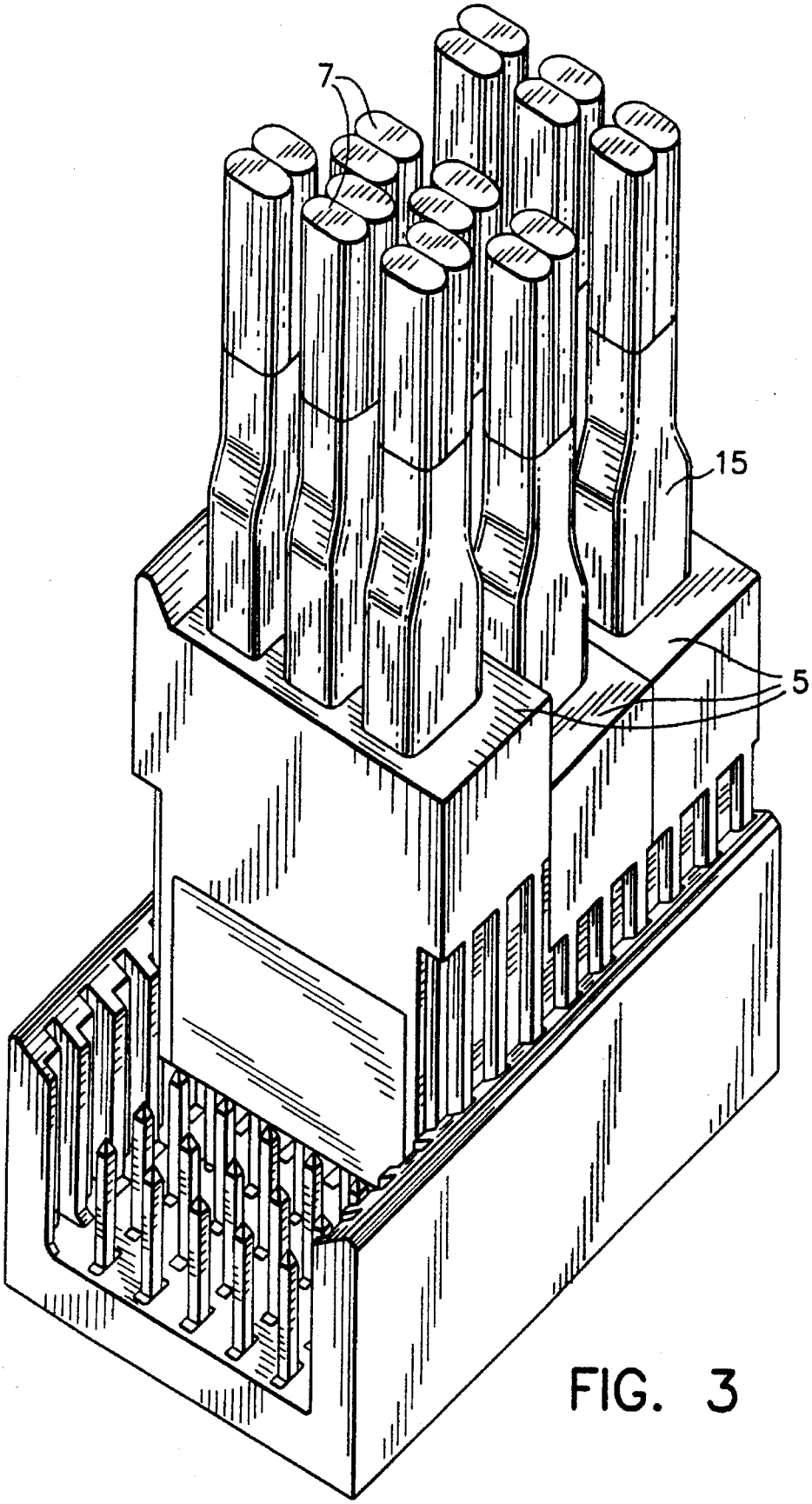
FIG. 3 is a perspective view of three connectors according to FIG. 2 being plugged into a corresponding coupling socket.

FIG. 1–3 show a first embodiment of the connector according to the invention, which connector 1 is provided with a housing 2 made of insulating material. This housing 2 is assembled of a module cap 3 wherein three modules 4 are detachably mounted in this module cap. The construction of the housing 2 is further described in a patent application of the applicant of the same date. For a further explanation of the construction of the housing reference is made to this patent application.

Figure 4:
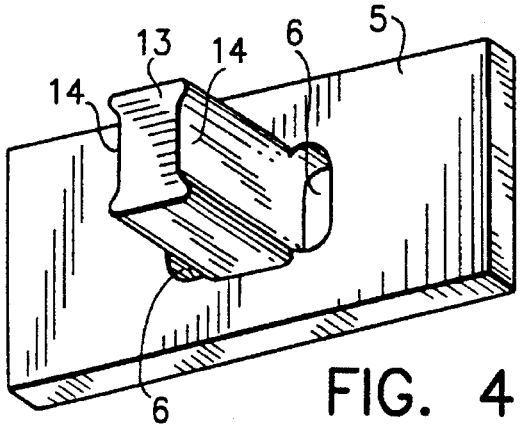
FIG. 4 is a perspective view of a part of the upper wall of the connector off FIG. 2, wherein for the sake of clarity the cables are not shown.

FIG. 4 shows a part of the upper wall 5 of the housing 2 in more detail. FIG. 4 shows that the upper wall 5 is provided with inlet openings 6 for feeding shielded cables 7 into the housing 2, said cables 7 being made as cables with a differential pair of signal conductors 8 in this case. The signal conductors 8 together with a ground or drain wire 9 are enclosed by a metallized foil 10 working as a shielding. An insulating jacket or outer jacket 11 is provided around the foil 10. The signal conductors 8 are insulated with respect to the shielding 10 by a plastic sheath 12 forming the dielectric determining the impedance of the cable. This plastic material is relatively easily deformable whereby the impedance of the cable 7 could be affected. For this reason the strain relief of the cables 7 with respect to the housing 2 should be provided in a careful manner. To this end the housing 2 is provided with strain relief members which in this embodiment each are made as a support 13 being unitary with the upper wall 5 of the housing and projecting from this upper wall along a part of the length of the cable 7. The support 13 has a support face 14 at both sides smoothly joining the inner wall of the corresponding inlet opening 6. The shape of the support face 14 is adapted to the shape of the insulating jacket 11 of the corresponding cable 7.

Due to the described shape of the supports 13 the forces on the cable 7 are distributed along a large surface, whereby deformation of the dielectric material 12 can be avoided in a controlled manner. In the embodiment of FIGS. 1–4, the two cables adjacent one support 13 are pressed on the support faces 14 by means of a shrink sleeve 15.

Figure 5:
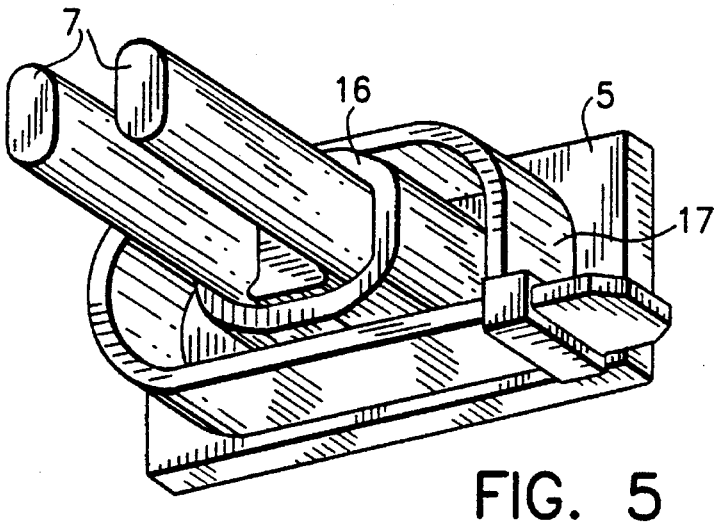
FIG. 5 is a perspective view of a part of the upper wall of an alternative embodiment of the connector according to the invention in a not yet completely assembled situation.
Figure 6:
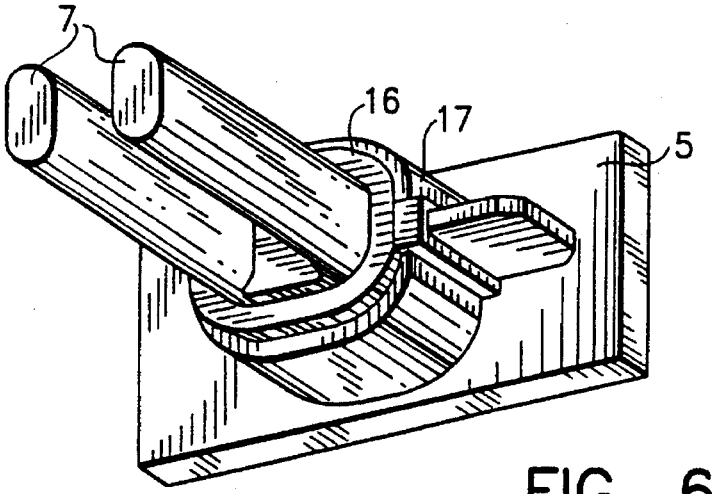
FIG. 6 shows the part of the connector of FIG. 5 in an assembled situation.

In FIGS. 5 and 6 a part of the upper wall 5 of a second embodiment of the connector is shown, which is made mainly in the same manner as the connector 1. In this case a filling ring 16 is provided around the two cables 7 adjacent the same support 13, said filling ring consisting of a material with a high friction with respect to the outer jacket 11, like rubber, for example. The filling ring 16 is pressed on the outer jacket 11 Of the cables 7 by means of a clamping strip 17.

Figure 7:
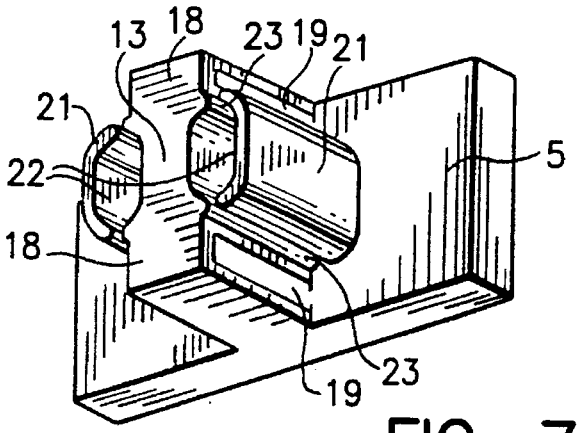
FIGS. 7–9 show a perspective view of a part of the upper wall of a third embodiment of the connector according to the invention in successive steps of assembly of the connector.
Figure 8:
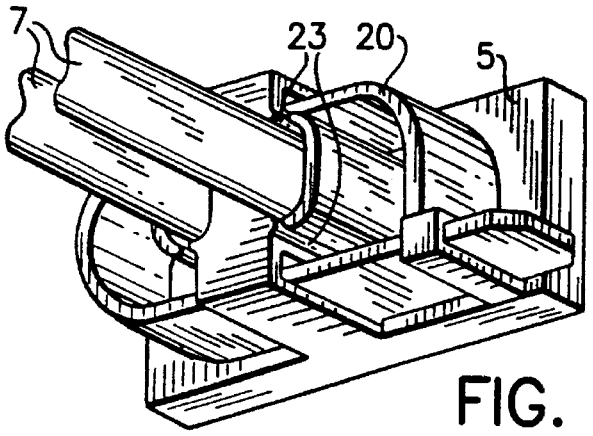
Figure 9:
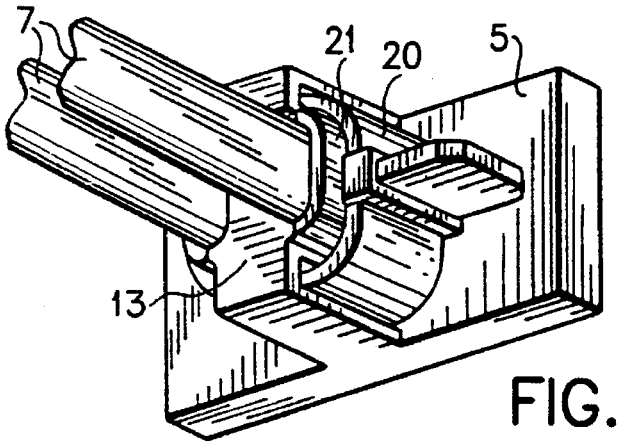
Figure 10:
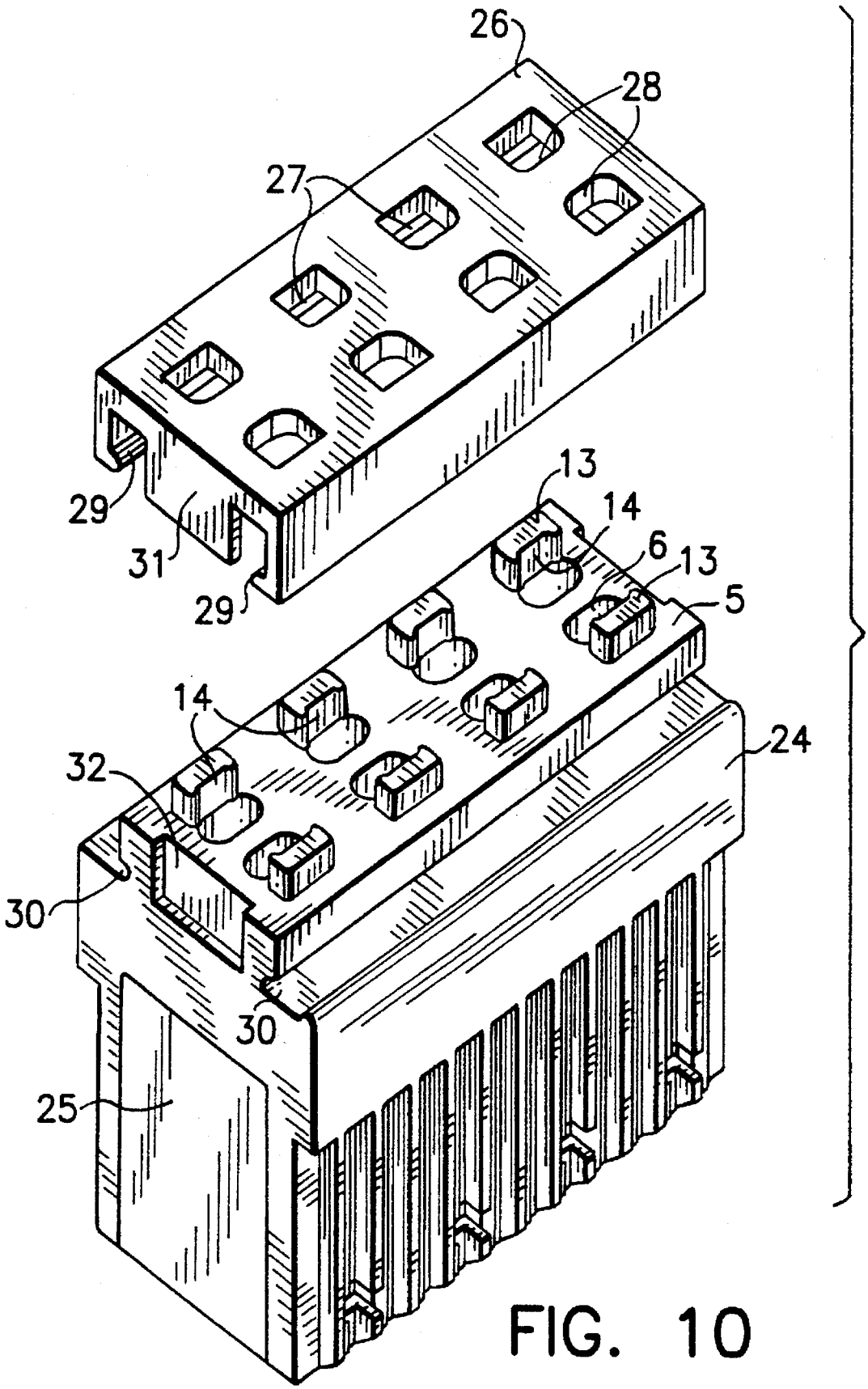
FIGS. 10–13 show a perspective view of a fourth embodiment of the connector according to the invention.

FIGS. 7–9 show a part of the upper wall 5 of a third embodiment of the connector according to the invention, which is mainly made in the same manner as the connector 1.

In this case the supports 13, one of which is shown in FIGS. 7–9, are provided at their ends with an extension 18 in which passage slots 19 for a clamping strip 20 are provided. Further, a flexible support 21 is provided opposite each support face 14 of a support 13 at the other side of the corresponding inlet opening 6 in this embodiment, said flexible support 21 also having a support face 22 adapted to the shape of the outer jacket 11 of the corresponding cable 7.

In FIGS. 8 the cables 7 are schematically indicated and the clamping strip 20 is already provided but not yet tightened. As can be seen in FIG. 7 and 8, a gap 23 is provided between the end edges of the flexible support 21 and the end edges of the corresponding support face 14 of the support 13. In the tightened position of the clamping strip 20 shown in FIG. 9, the gap 23 at the upper side of the flexible support 21 is closed, whereby the pressing forces on the outer jacket 11 of the cables 7 are limited. Thereby, the compression of the insulating material of the cable is restricted and the clamping force is limited.

FIGS. 10–13 show a fourth embodiment of the connector according to the invention which is provided with a housing 2 assembled of a module cap 24 and modules 25. The upper wall 5 of the housing 2 is provided with supports 13 with support faces 14 joining the inlet openings 6 in the described manner. As pressing member a clamping plate 26 is provided in this embodiment having a passage 27 for each support 13 and corresponding cable 7. Each passage 27 has an inner wall part 28 pressing the cable 7 against the support face 14 of the support 13.

The clamping plate 26 is provided with locking edges 29 at its longitudinal Sides, said locking edges 29 cooperating with complementary locking edges 30 formed at the upper side of the module cap 24. At both longitudinal ends the clamping plate 26 is provided with a lip 31 which is received in a recess 32 at the upper side of the module cap 24 when the clamping plate 26 is mounted on the cap.

Figure 11B:
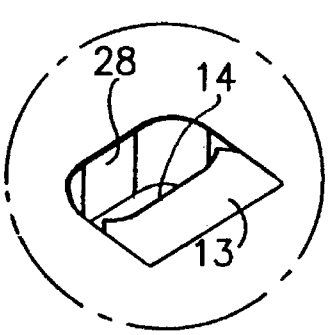
Figure 11:
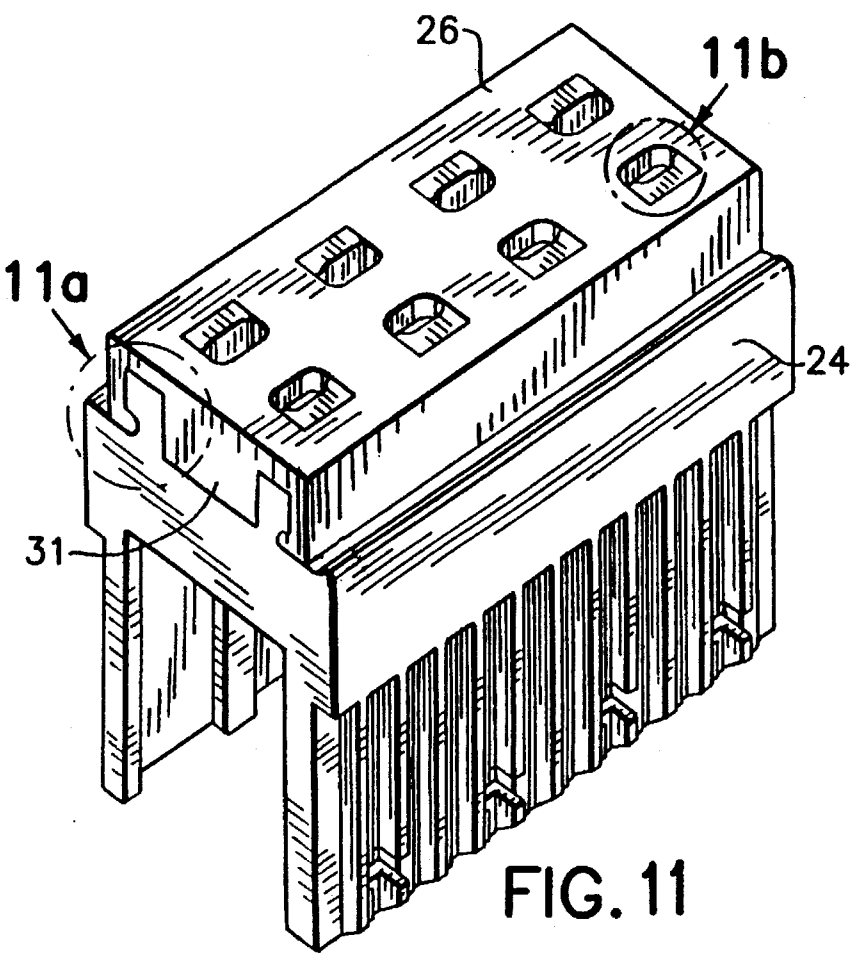
Figure 11A:
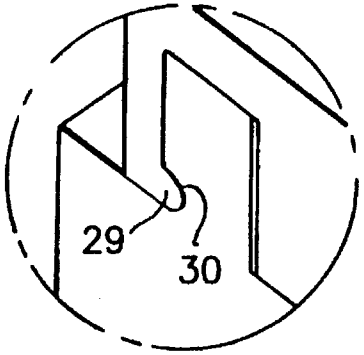

In FIG. 11 the clamping plate 26 is snapped on the upper side of the module cap 24 and in a first detail it is shown how the locking edges 29, 30 engage one on the other while in a second detail it is shown how a passage 27 with a support 13 provides a cavity in which the cable 7 is clamped.

Figure 12:
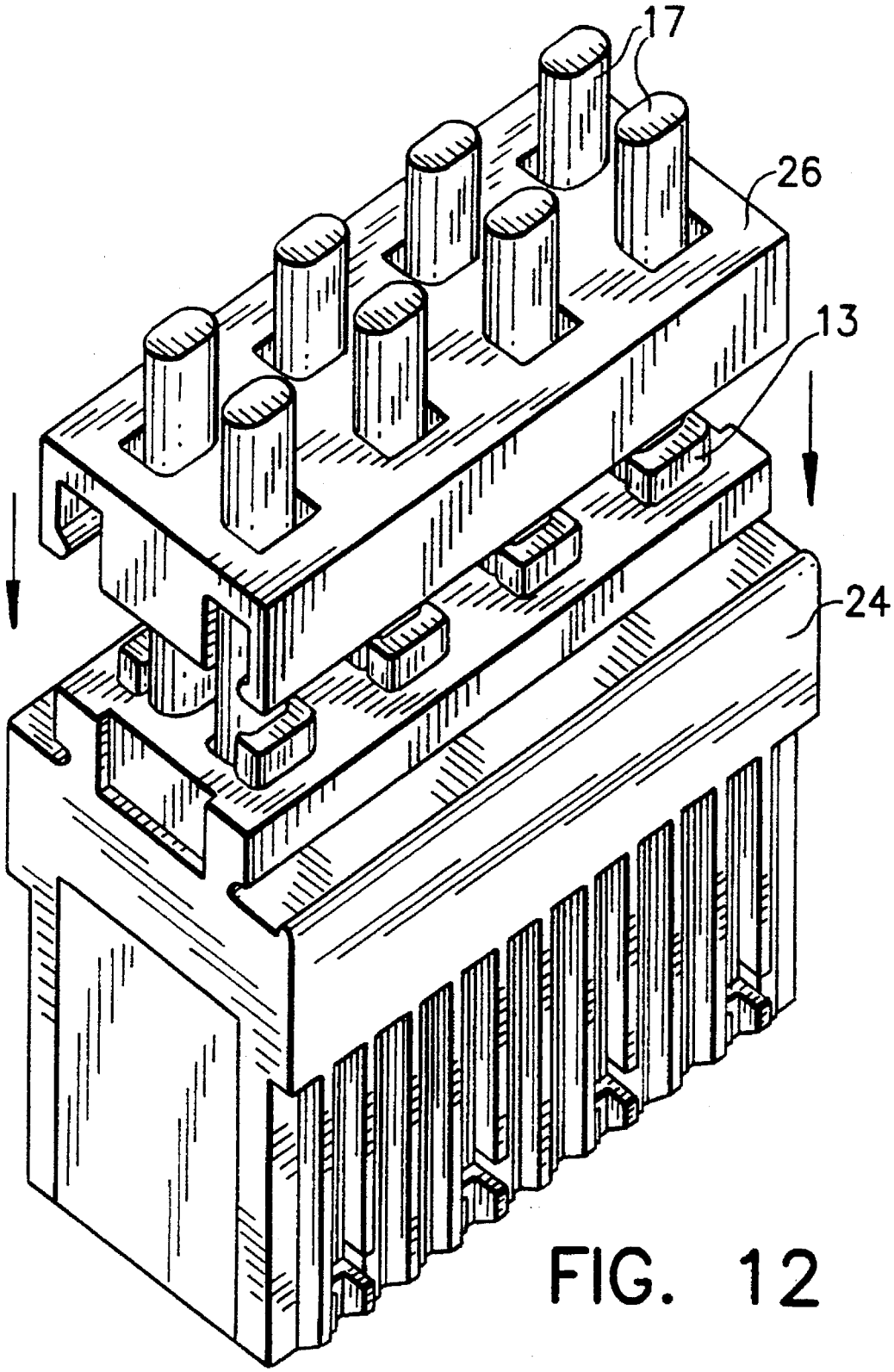
Figure 13:
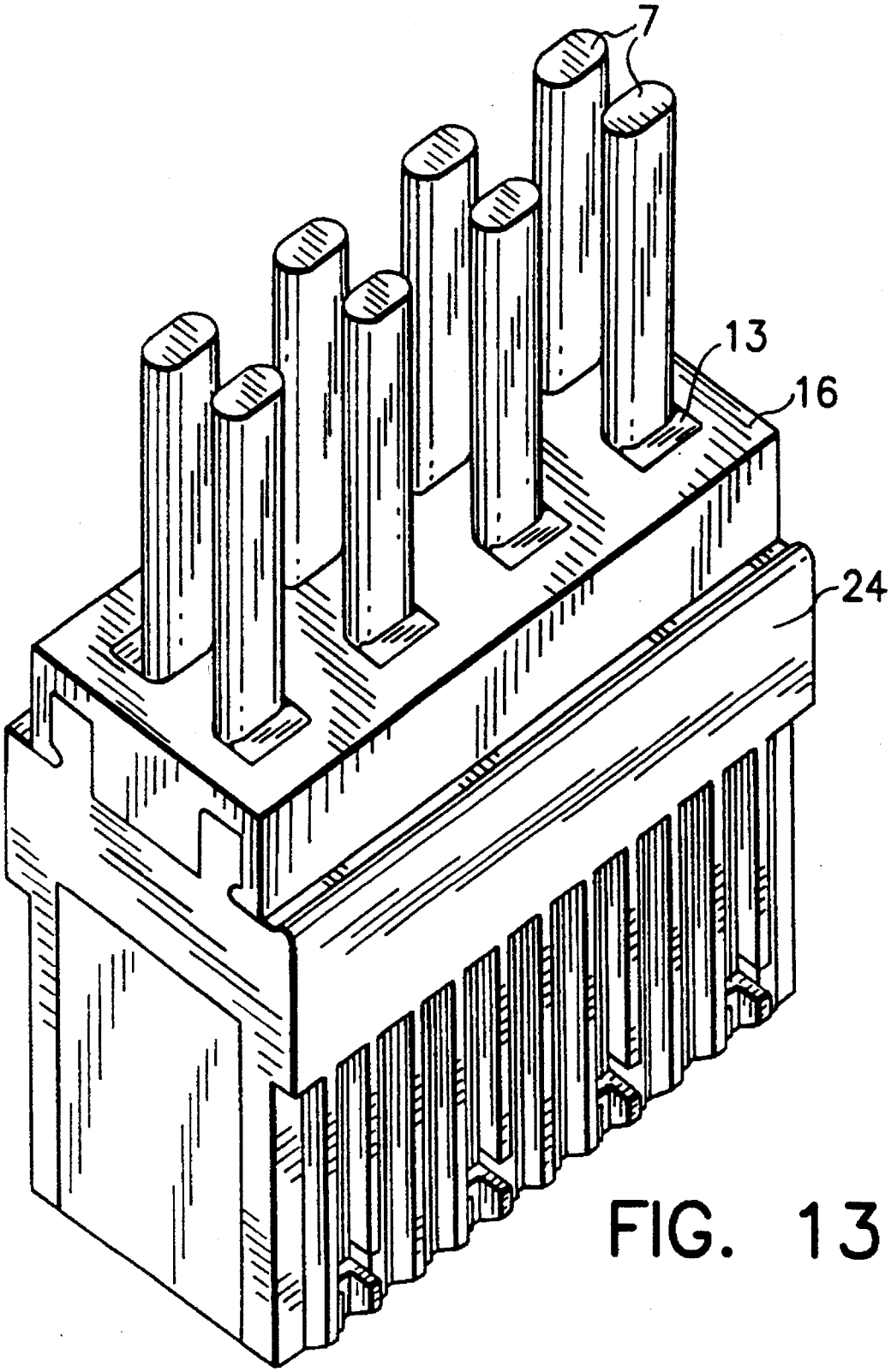

FIG. 12 and 13 show the manner for snapping the clamping plate 26 on the module cap 24 after first feeding the cables 7 through the passages 27 and then connecting the cables with the contact elements not shown in the housing 2.

Figure 14:
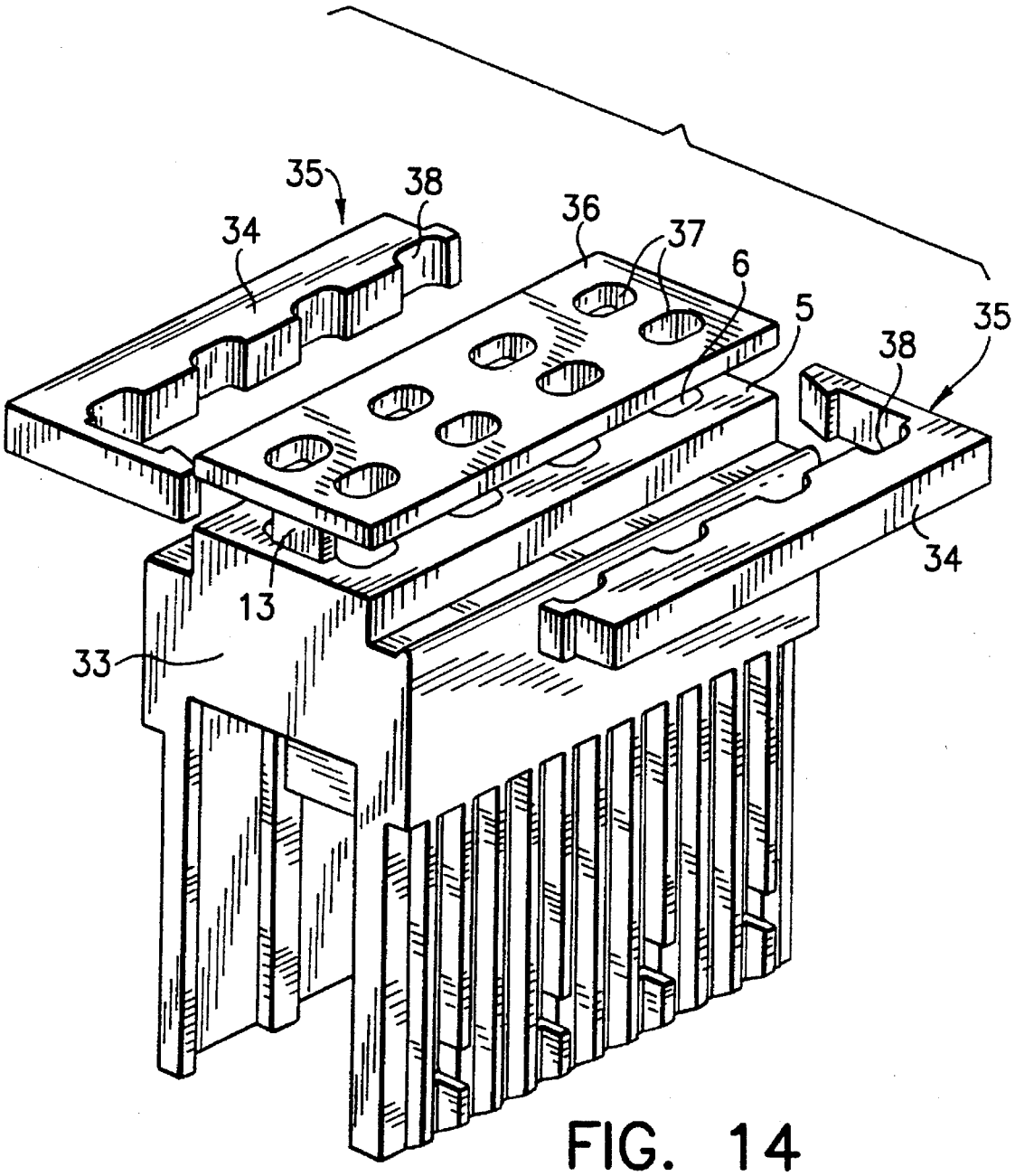
FIG. 14 shows a perspective view of a fifth embodiment of the connector according to the invention in disassembled position.

In FIG. 14 a fifth embodiment of the connector according to the invention is shown in disassembled position. FIG. 14 only shows a module cap 33 without corresponding modules, wherein a clamping element 35 comprising two identical parts 34 is shown. In this embodiment the supports 13 are provided with a support face 14 at both sides, which support face 14 joins in inlet opening 6 for a cable 7 in the described manner. The supports 13 join at their upper side an end plate 36 with passages 37 aligned with the inlet openings 6. Between the end plate 36 and the upper wall 5 of the module cap 33 a free space is provided for receiving the clamping element 35.

Figure 18A:
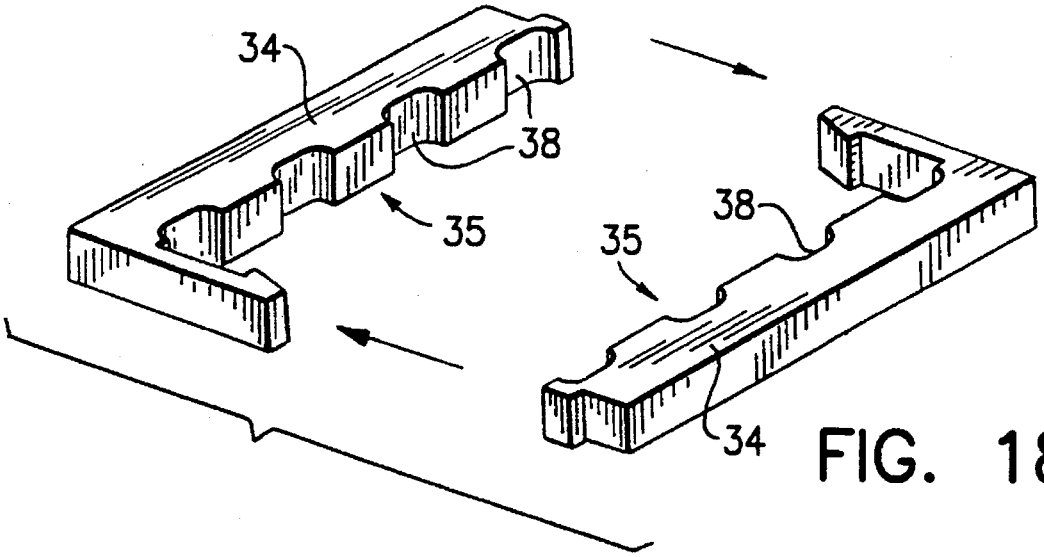
FIGS. 18*a* and 18*b* show a perspective view of the clamping element of the connector of FIG. 14 in two positions.
Figure 18B:
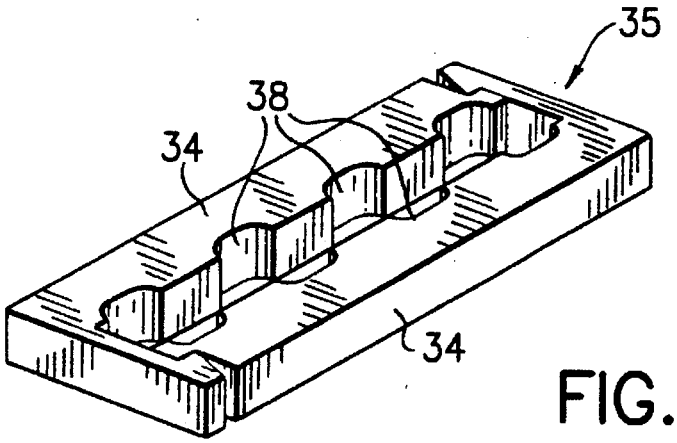

The clamping element shown in FIG. 18 *a* and 18 *b* in an open inoperative position and a closed operative position, respectively, is provided with wall parts 38 adapted to the shape of the outer jacket of the cable 7. When the clamping element parts 34 are coupled with each other as shown in FIG. 18*b* in the space between the end plate 36 and the upper wall 5 of the module cap 33, the wall parts 38 press the cables against the support faces 14 of the supports 13, whereby the desired strain relief is obtained.

Figure 15:
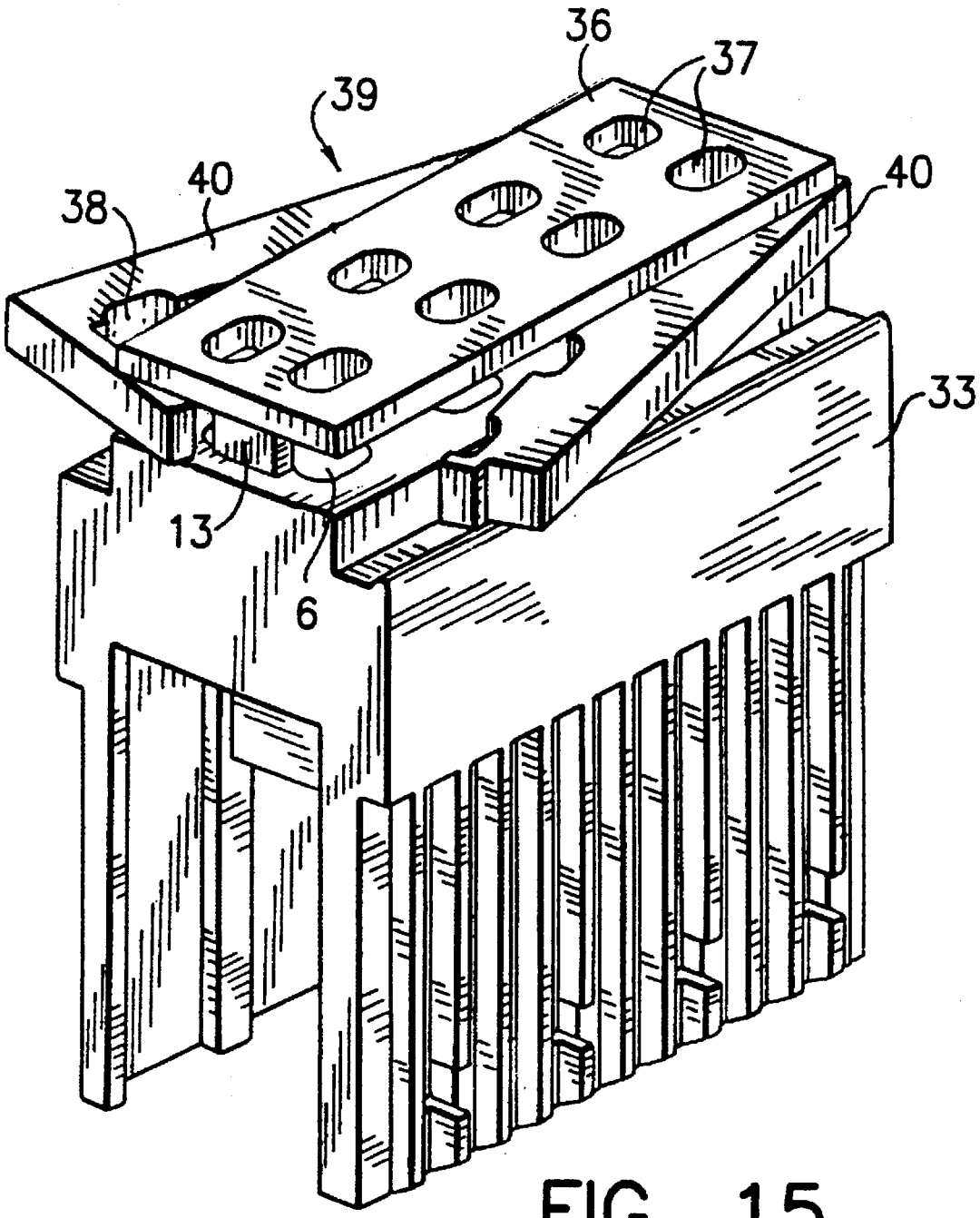
FIG. 15 shows a perspective view of a sixth embodiment of the connector according to the invention in disassembled position.
Figure 16:
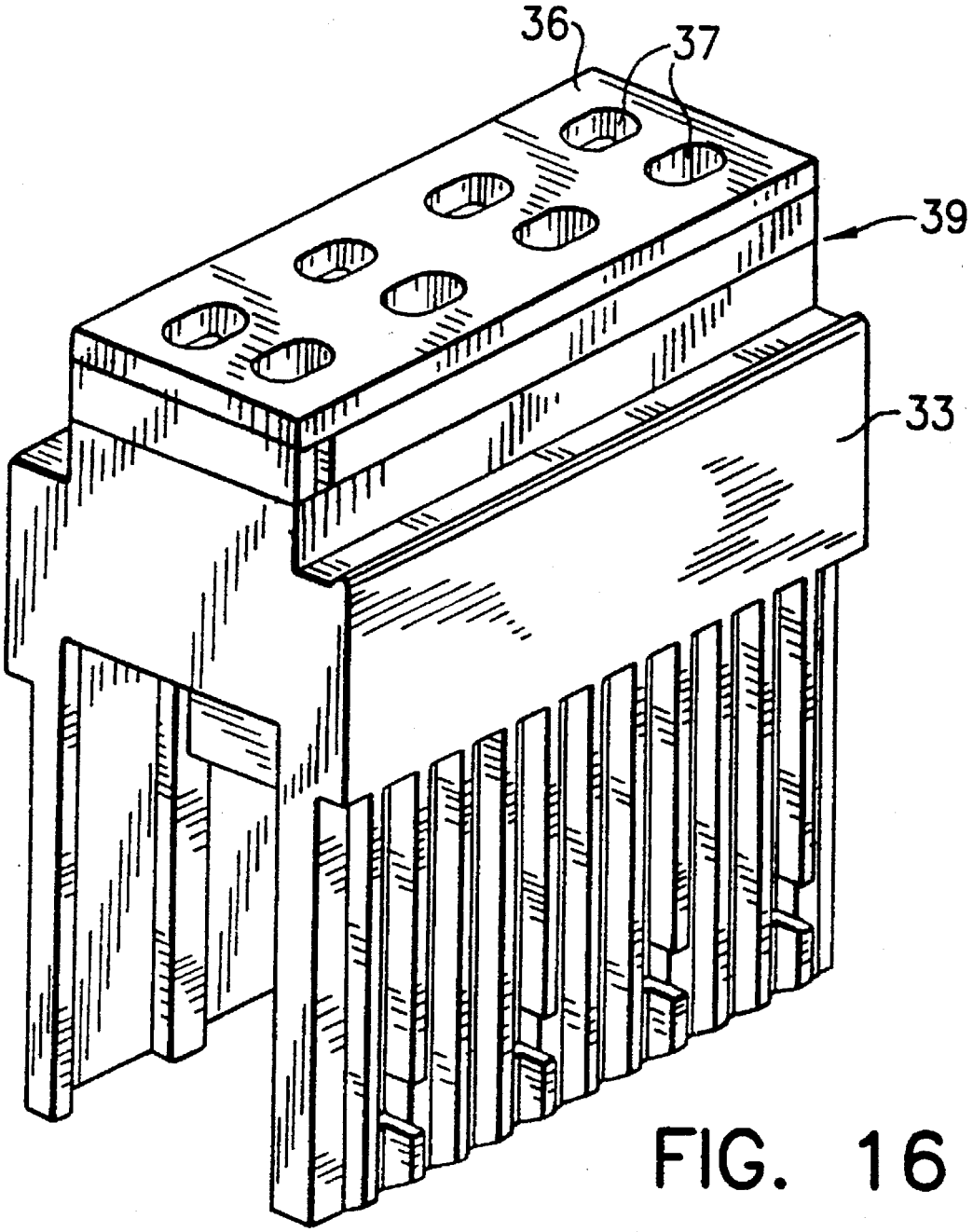
FIG. 16 shows the connector of FIG. 15 in a partially assembled position.
Figure 17:
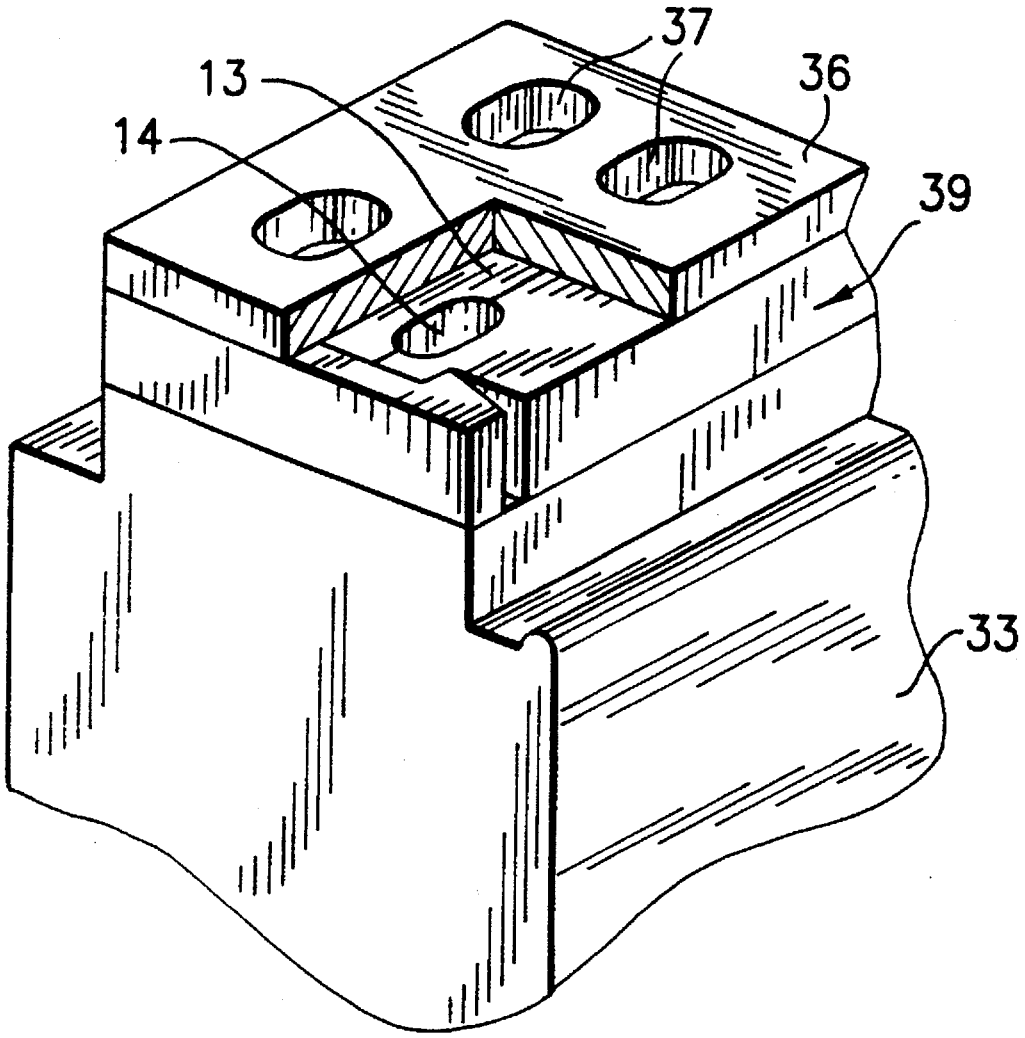
FIG. 17 shows a detail of the connector of FIG. 16.
Figure 19A:
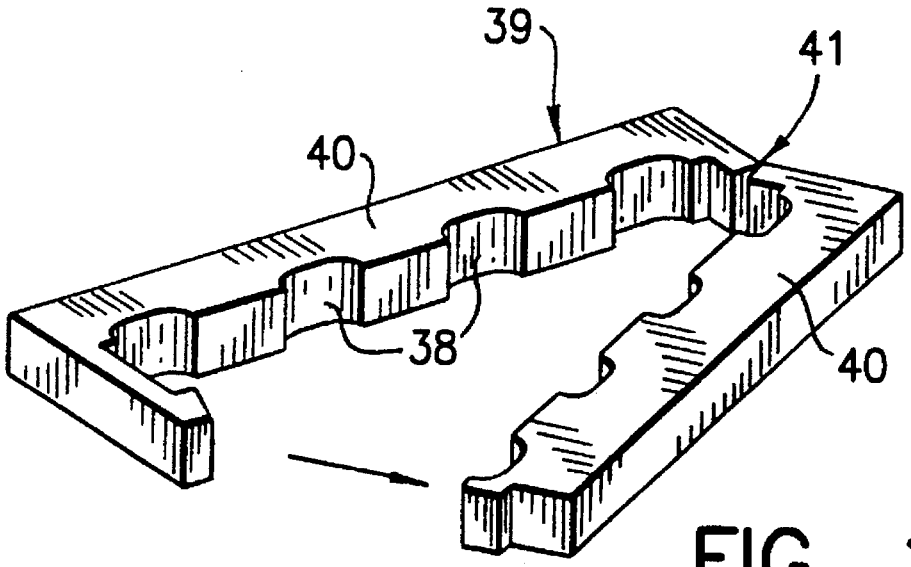
FIGS. 19*a* and 19*b* shows a perspective view of the clamping element of the connector of FIG. 15 in two positions.
Figure 19B:
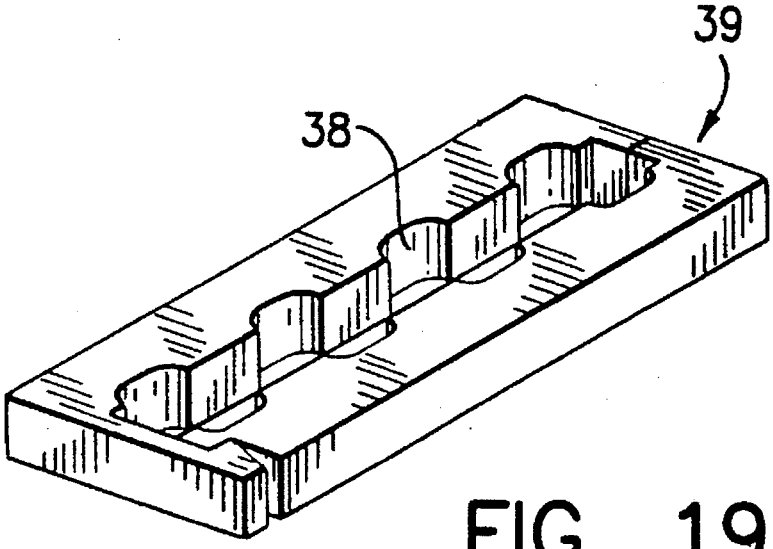

FIG. 15 shows a sixth embodiment, of which the module cap 33 is made in the same manner. In this case a clamping element 39 is used shown in FIG. 19 *a* and 19 *b* in the open inoperative position and the closed operative position, respectively. This clamping element 39 consists of two parts 40 which are interconnected by a film hinge 31 and at the other side can be coupled with each other as shown. In FIG. 16 the clamping element 39 is mounted in the operative position between the end plate 36 and the upper wall 5 of the module cap 33. FIG. 17 shows a detail of the module cap 33 with mounted clamping element 35 or 39, respectively, wherein the cavity is shown which is provided by the support 13 and the opposite wall part 38 and in which the cable 7 is clamped.

The invention is not restricted to the above-described embodiments which can be varied in a number of ways within the scope of the claims.

What is claimed is:

1. A connector for shielded cables, said cables each having an outer jacket, said connector comprising a housing with signal and ground contacts mounted in said housing, said housing having an upper wall with inlet openings for the cables and at least one strain relief member joining the inlet openings, each strain relief member being integrally formed with the upper wall of the housing and projecting from said upper wall, wherein each strain relief member comprises a support projecting from the upper wall and having a support face adapted to receive the outer jacket of at least one of the cables, a pressing member being provided for pressing at least one of the cables with its outer jacket against the support face of the strain relief member.

2. A connector according to claim 1, wherein at least one of the supports joins one of the inlet openings at two opposing sides and comprises the support face at the two opposing sides adapted to receive the outer jacket of a cable.

3. A connector according to claim 1, wherein a filling ring and a clamping strip are provided around the support and at least one cable, said filling ring being made of a material with a high friction with respect to the outer jacket of said at least one cable.

4. A connector according to claim 1, wherein the pressing member encloses the support and at least one cable and is made as a shrink.

5. A connector for shielding cables, said cables each having an outer jacket, said connector comprising a housing with signal and ground contacts mounted in said housing, said housing having an upper wall with inlet openings for the cables, at least one strain relief member for the cables joining the inlet openings, each strain relief member being unitary with the upper wall of the housing and projecting from said upper wall, wherein each strain relief member comprises a support projecting from the upper wall and having a first support face adapted to receive the outer jacket of one of the cables, a pressing member being provided for pressing at least one of the cables with its outer jacket against the first support face of the strain relief member, wherein a flexible support with a second support face adapted to receive the outer jacket of at least one of the cables is provided opposite each first support face at an opposite side of a corresponding one of the inlet openings, wherein said pressing member is made as a clamping strip and passage slots for the clamping strip are provided in the support.

6. A connector according to claim 5, wherein each flexible support has end edges located at a predetermined distance from end edges of the first support face of the opposite respective support.

7. A connector according to claim 5, wherein the pressing member is made as a clamping plate with at least one passage for receiving at least one of the supports and at least one of the cables, said passage having an inner wall part for pressing a cable through the flexible support and against the support face of the support.

8. A connector according to claim 5, wherein the pressing member is made as a clamping element which is movable from an open, inoperative position to a closed, operative position, wherein the clamping element, in its operative position, encloses at least one support and at least one cable and presses, with a wall part, the cable through the flexible support against the first support face of said at least one support.

9. A connector for shielding cables, said cables each having an outer jacket, said connector comprising a housing with signal and ground contacts mounted in said housing, said housing having an upper wall with inlet openings for the cables, a strain relief member for each cable joining each of the inlet openings, each strain relief member being unitary with the upper wall of the housing and projecting from said upper wall, wherein each strain relief member comprises a support projecting from the upper wall and having a support face adapted to receive the outer jacket of at least one of the cables, a pressing member being provided for pressing the at least one Cable with its outer jacket against the support face of the strain relief member, wherein the pressing member is made as a clamping plate with at least one passage for receiving the support and the at least one cable, said passage having an inner wall for pressing the cable directly against the support face of the support wherein the clamping plate can be detachably locked on the upper wall of the housing.

10. A connector according to claim 9, wherein each passage has an inner wall part adapted to receive the outer jacket of the cable.

11. A connector according to claim 10, wherein the clamping plate has passages for all of the supports of the housing, the clamping plate having longitudinal sides provided with locking edges cooperating with complementary locking edges at an upper side of the housing.

12. A connector for shielding cables, said cables each having an outer jacket, said connector comprising a housing with signal and ground contacts mounted in said housing, said housing having an upper wall with inlet openings for the cables, a strain relief member for each cable joining the inlet openings, each strain relief member being unitary with the upper wall of the housing and projecting from said upper wall, wherein each strain relief member comprises a support projecting from the upper wall and having a support face adapted to receive the outer jacket of at least one of the cables, a pressing member being provided for pressing the cable with its outer jacket against the support face of the strain relief member, wherein the pressing member is made as a clamping element that is movable from an open, inoperative position to a closed, operative position, wherein the clamping element, in its operative position, encloses at least one support and at least one cable and presses, with a wall part, the cable directly against the support face of said at least one support.

13. A connector according to claim 12, wherein said wall part of the clamping element is adapted to receive the outer jacket of the cable.

14. A connector according to claim 12, wherein the clamping element consists of two identical halves which can be detachably connected with each other.

15. A connector according to claim 12, wherein the clamping element consists of two halves which are interconnected at one side by a film hinge and at another side can be detachably connected with each other.

16. A connector according to claim 12, wherein the clamping element is a common clamping element for all supports of the housing.

17. A connector according to claim 16, wherein an end plate with passages for the cables is provided on the supports, wherein an open space is provided between the end plate and the upper wall of the housing for receiving the clamping element.

* * * * *